United States Patent [19]

Kiang

[11] 4,167,288

[45] Sep. 11, 1979

[54] TV CHAIR WITH DOUBLE PILLOW CASE AND TWO-STEP OTTOMAN

[76] Inventor: Piao Kiang, 146, Hsin-I Road, III, Taipei, Taiwan, Taiwan

[21] Appl. No.: 874,932

[22] Filed: Feb. 3, 1978

Related U.S. Application Data

[63] Continuation-in-part of Ser. No. 671,946, Mar. 30, 1976, Pat. No. 4,078,841.

[51] Int. Cl.[2] ..... A47C 1/02

[52] U.S. Cl. ..... 297/378; 297/68; 297/317; 297/342

[58] Field of Search ..... 297/379, 378, 342, 341, 297/318, 317, 83, 88, 68, 85, 340, 118

[56] References Cited

U.S. PATENT DOCUMENTS

| | | | |
|---|---|---|---|
| 780,252 | 1/1905 | Wylie | 297/379 X |
| 2,402,832 | 6/1946 | Muller | 297/379 |
| 3,321,243 | 5/1967 | Ferrara | 297/378 |
| 3,858,932 | 1/1975 | Crum | 297/83 X |
| 3,947,069 | 3/1976 | Lusch | 297/341 X |
| 4,072,342 | 2/1978 | Johnson | 297/318 X |

*Primary Examiner*—James T. McCall

*Attorney, Agent, or Firm*—Cushman, Darby & Cushman

[57] ABSTRACT

A recliner chair having seat and back portions pivotally connected and supported on a frame structure for movement between an upright position and an inclined position with supporting rollers secured to the seat and rear portions of the frame structure and movable along track means secured thereto.

The improved chair includes a modified stop mechanism associated with the rear and front seat supporting rollers and the tracks connected therewith. One stop member includes a bracket mounted on the frame structure which is located in the rear area of the siderail, and serves to stop rearward movement of the rear seat support roller. The bracket includes a retaining member which holds that rear roller therein and accordingly maintains the seat in an upright position. Another stop member is associated with the front support roller and in particular is formed from the rear portion of the track member moving thereon and maintains the seat in its inclined position.

3 Claims, 17 Drawing Figures

TV CHAIR WITH DOUBLE PILLOW CASE AND TWO-STEP OTTOMAN

This is a continuation-in-part of application Ser. No. 671,946 filed Mar. 30, 1976, now U.S. Pat. No. 4,078,841.

BACKGROUND OF THE INVENTION

1. Field of the Invention

This invention relates to a recliner chair and more particularly, to a reclining chair having two positions.

2. The Prior Art

A multitude of reclining chairs have been invented which use rather complicated mechanisms to move the bottom and back portions of the seat member between a plurality of positions. Such devices include complicated lever mechanisms and bottom and back portions which are moved independently to new positions in order to accommodate the human form. The more complicated such devices become, the more expensive they are and the more likely they are to break down or be easily damaged so as to make them inoperable.

SUMMARY OF THE INVENTION

The present invention is intended to overcome the disadvantages and difficulties associated with such prior art devices by providing a simple means for moving the seat bottom and back portions between two positions, a sitting position and a reclining position. In the sitting position the seat is so retained that only a slight amount of pressure, appropriately applied, is required to cause the chair to move to the reclining position.

These advantages are accomplished by the present invention by utilizing a simple rigid frame structure and a seat member having back and bottom portions pivotally attached to each other and mounted to the frame structure for movement between an upright sitting position and a reclining position.

Rollers are secured to the upper rear portion of each side of the frame and are associated with a corresponding track means attached to each side of the rear of the back portion of the seat. Rollers are also positioned on each side of the seat coincident with the pivotal axis between the back and bottom portions of the seat and are supported so as to roll along the upper surface of the side elements when the seat is moved from an upright position to an inclined position and vice versa.

The bottom portion of the seat preferably contains a separate track means on each side thereof which ride on associated rollers attached to the front lower portion of each side of the frame member to permit the seat to move forward and back between the upright and inclined positions.

Included is an improved stop means for retaining the seat respectively in its upright or inclined position. In particular, the improved stop means includes two separate stop members which respectively cooperate with the set of rollers positioned on the seat coincident with the pivotal axis of the seat's back and bottom portions and the rollers mounted on the front part of the frame structure which support the front of the seat's bottom portion. The first stop member associated with the latter rollers seems to limit movement of the seat from going beyond a predetermined inclined position and is positioned on the end of the track mounted on each side of the front area of the seat's bottom portion.

The second stop member comprises a bracket type device positioned on each side of the chair's frame structure at the point where the pivotal connection between the seat back and bottom would be positioned when the seat is in its upright position. The second stop member is designed to receive the rollers attached to the seat coincident with that pivotal connection and includes a retaining means. Thus, rearward movement of such rollers along the upper surface of the side frame is stopped when the seat reaches the desired upright position with the retaining means holding the seat in that position until a suitable force is applied to the seat back or bottom which overcomes the effect of the retaining means to move the seat from its upright to its inclined position.

By using this improved system for stopping seat movement in its reclined and upright positions, it becomes easier to fold the back portion of the seat over onto the bottom portion since it will not be necessary to move the chair out of its retained upright position as was previously the case.

An adjustable pillow is attached by a flexible cord or piece of fabric to a counterweight disposed on the rear side of the upper back portion of the seat member within a sheath which permits the counterweight to slide up or down therein and retain the pillow in the desired position.

An ottoman has an upper cushion portion which is movable between up and down positions wherein the upper surface of the cushion member is movable between positions which correspond to the positions of the seat member of the reclining chair so as to provide a comfortable position for the legs of a person sitting in the chair when it is in either the upright position or the reclining position.

DETAILED DESCRIPTION OF THE PREFERRED EMBODIMENT

Figures 1, 2, 3:
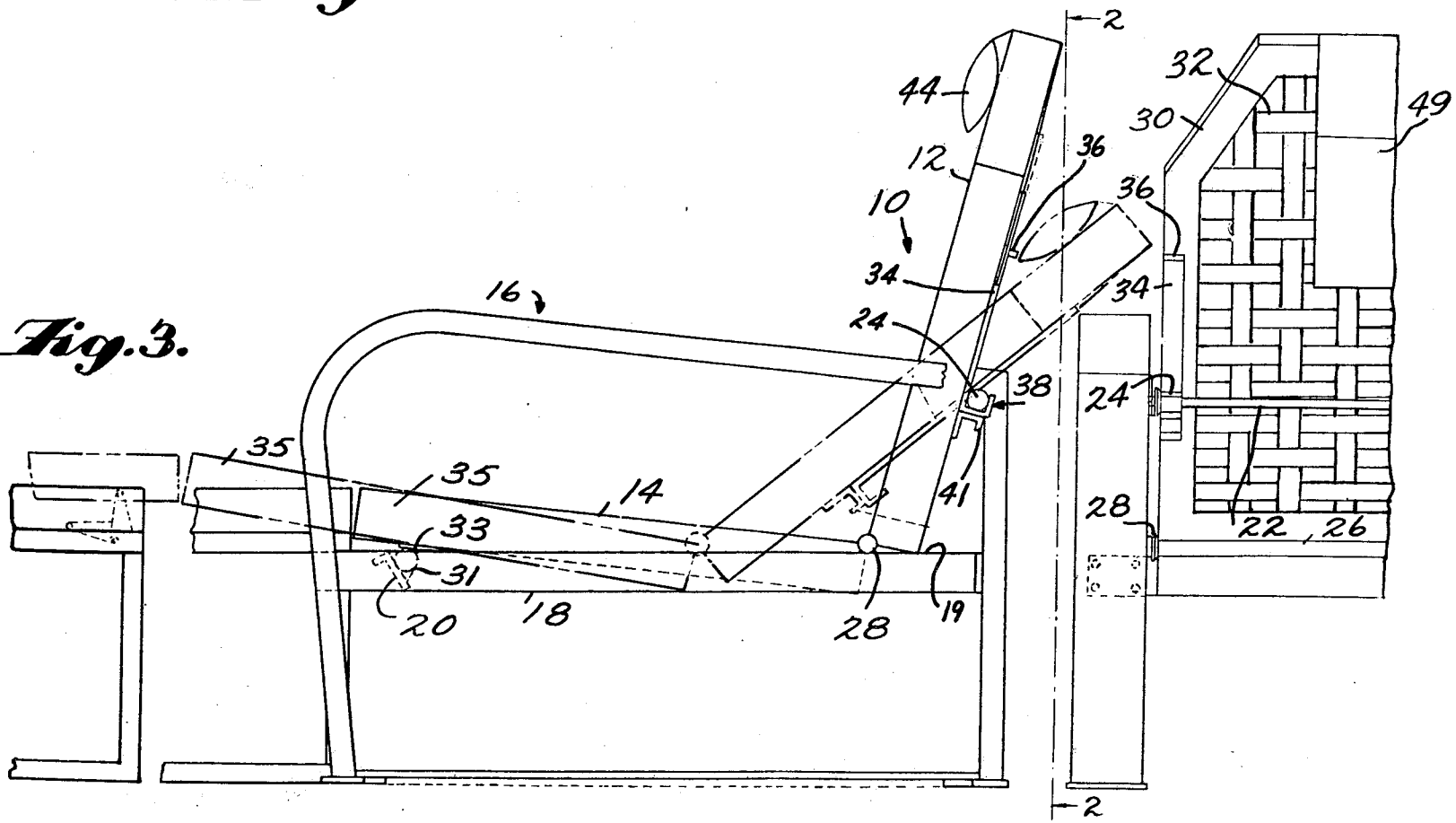
FIG. 1 is a side elevational view of one embodiment of a reclining chair according to the present invention.
FIG. 2 is a rear elevational view of a portion of the recliner chair of FIG. 1.
FIG. 3 shows an ottoman in connection with the adjustable chair of FIG. 1.
Figures 4, 5:
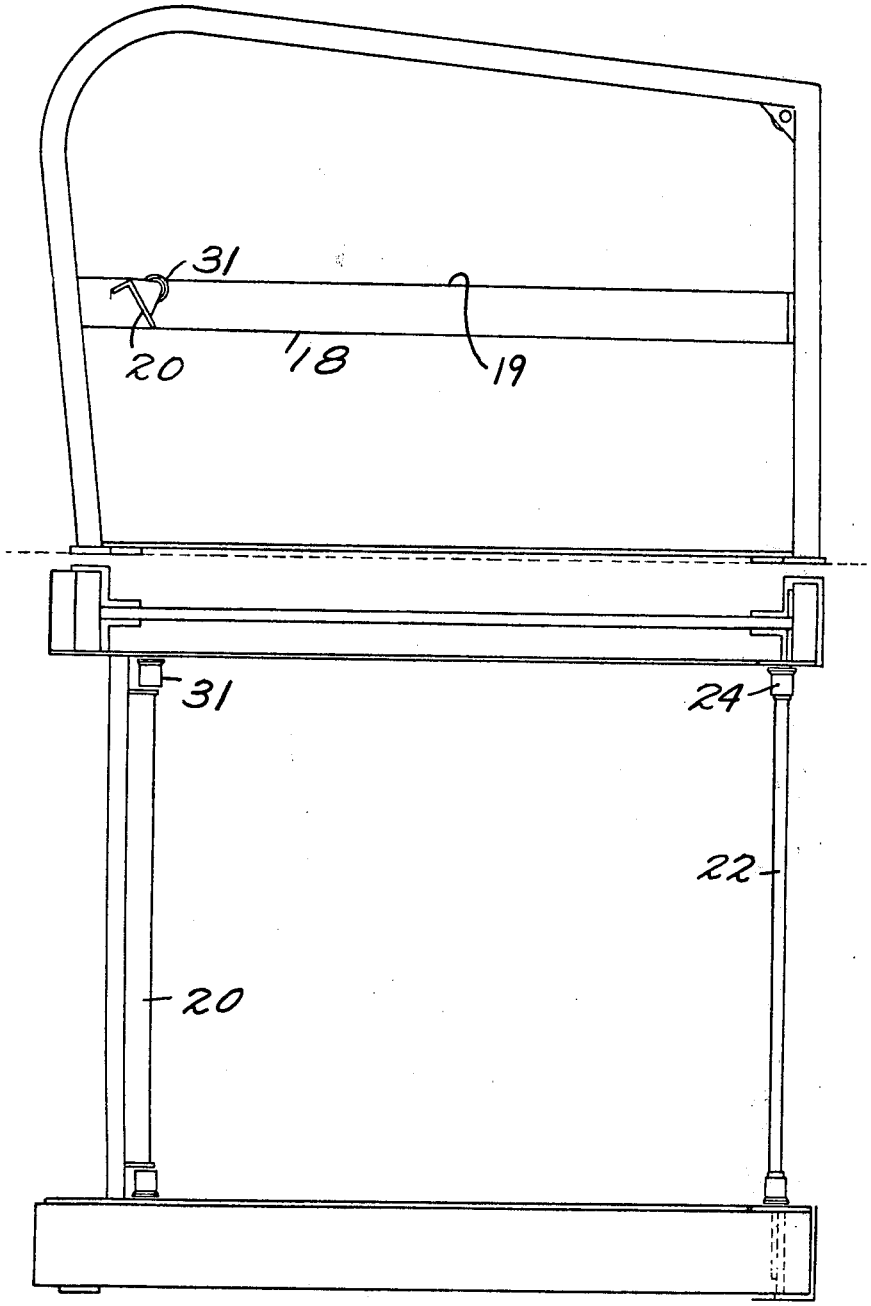
FIG. 4 is a side elevational view of a portion of the rigid frame structure of the chair of FIG. 1.
FIG. 5 is a top plan view of the rigid frame structure of the chair of FIG. 1.

Referring more particularly to FIG. 1, a seat member 10 is provided with a back portion 12 and a bottom portion 14 positioned in a rigid frame structure consisting of a pair of side frames 16, one positioned on each side of the seat member and each having a cross or side member 18. The cross or side members 18 are secured together by a front brace member 20, while the rear portion of the frame members 16 are secured together at the upper rear portion thereof by rod 22 which has rollers 24 secured to the ends thereof adjacent each side frame in supporting relation to the back portion 12.

The back portion 12 and bottom portion 14 of seat member 10 are pivotally attached to each other preferably along inner upper adjacent edges of each by any suitable means such as a hinge extending substantially across the seat 10, and having axial rod 26 extending therethrough so as to provide a pivotal axis for the seat back and bottom portions. Coincident with the pivotal axis and attached on each side of the seat member 10 to the ends of rod 26, are rollers 28 which are free to rotate and ride on the upper surface 19 of the side members 18, constituting a substantially horizontal track means for the rollers.

Supporting the bottom portion 14 at the front portion thereof are rollers 31, one of each of which is secured for rotation to each frame side member 18 beneath the bottom portion 14. Secured to the underside of bottom portion 14 are track means 33, one of each of which is associated with a corresponding roller 31 for supportive movement thereon. When the seat member 10 is moved from the upright position to the inclined position, the bottom portion 14 moves from the position shown in solid lines in FIG. 1 to the position shown in phantom, so that the front portion 35 of the seat bottom portion 14 moves forwardly and upwardly to a new height.

Figure 6:
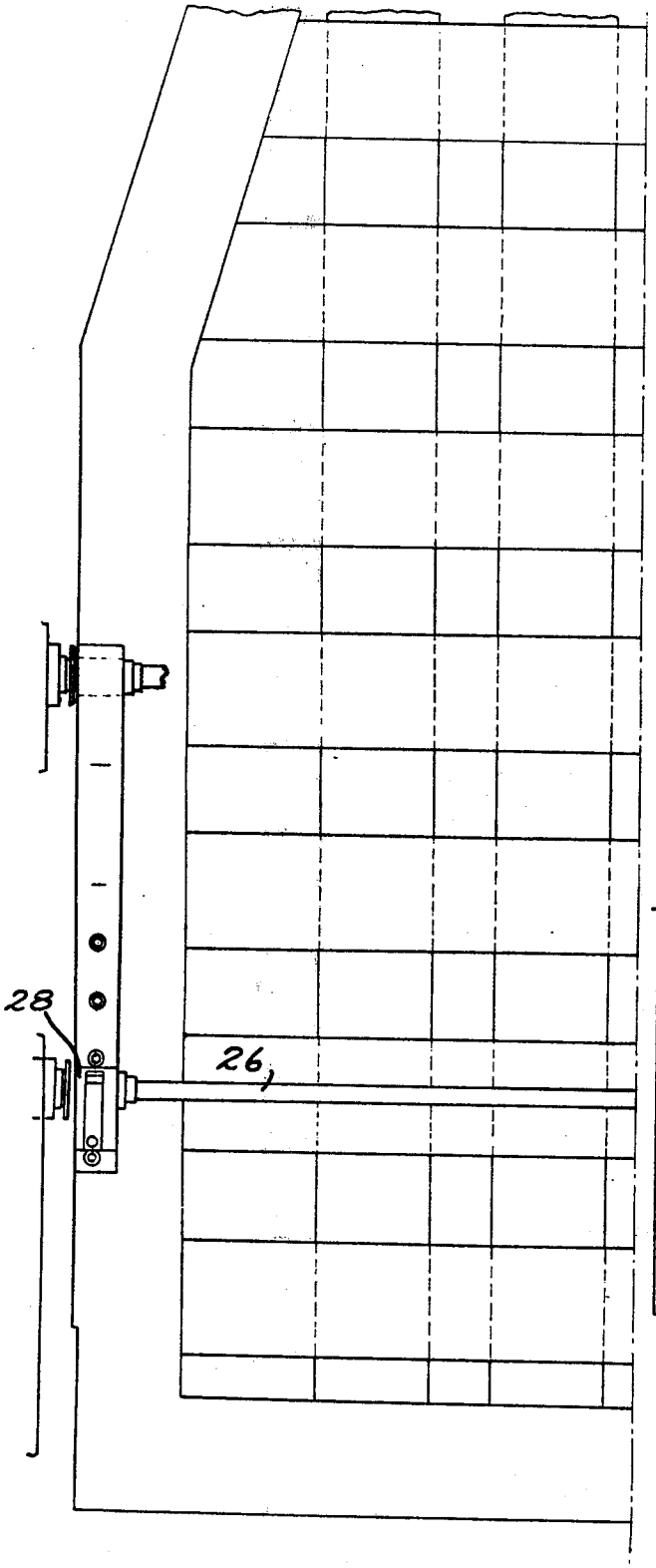
FIG. 6 is a rear elevational view of a portion of the back portion of the chair of FIG. 1.
Figure 8:
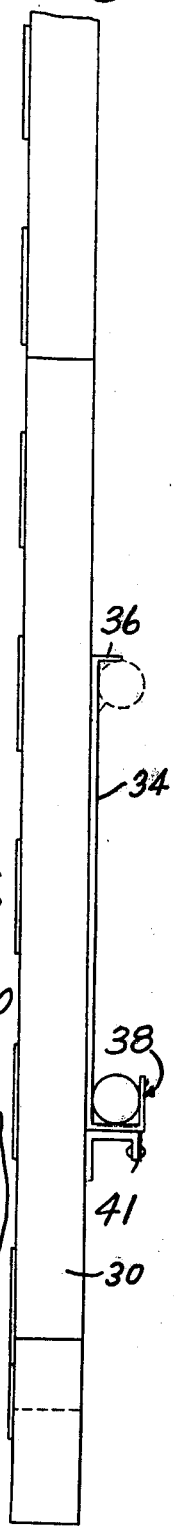
FIG. 8 is a side plan view of the portion of the chair illustrated in FIG. 6.
Figure 7:
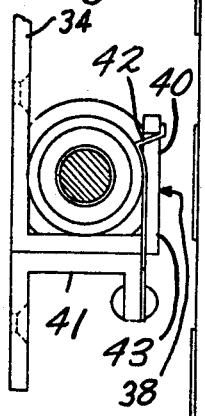
FIG. 7 shows an expanded view in partial cross section of the track means and retainer associated with the back portion of the chair of FIG. 1.
Figure 11:
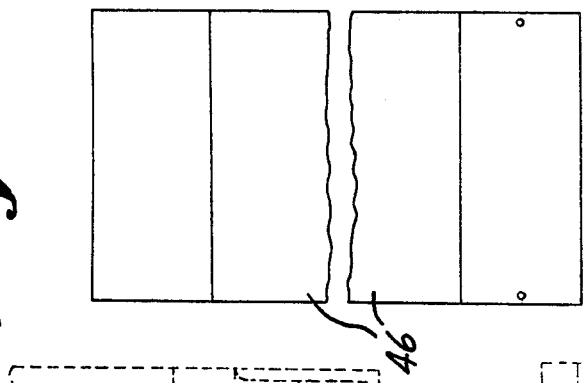
FIG. 11 is a top plan view of the pillow means attached to the chair in FIG. 1.
Figure 12:
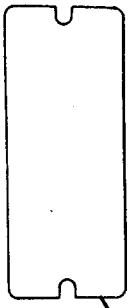
FIG. 12 is a top plan view of the counterweight secured to the pillow means.
Figure 13:
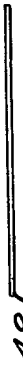
FIG. 13 is a side view of the counterweight illustrated in FIG. 12.
Figure 10:
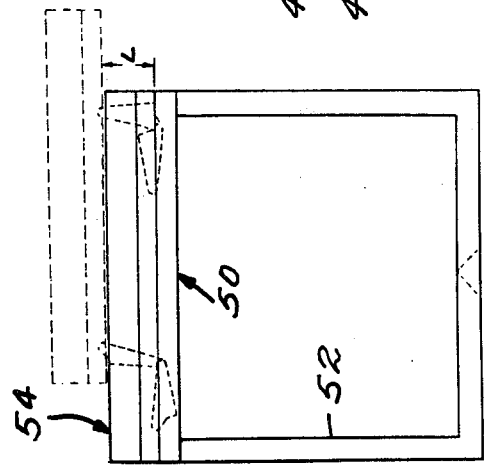
FIG. 10 is a side elevational view of the ottoman illustrated in FIG. 3.

The seat back portion 12 and bottom portion 14 are made up of a frame member 30 and a webbing 32 attached to the frame to provide a cushion on which to set. Actually, any other type of cushion may be utilized with regard to the present invention. Attached to the rear side of frame 30 are track means 34, one being positioned on each side and associated with rollers 24 which ride thereon. At the upper end of each of the track means 34 is a bent portion 36 which extends substantially perpendicular to the track means which constitutes a stopper for roller 24 when the chair is in the inclined position. At the bottom end of each track means 34 is a bent portion forming a U-shaped cross section 38 which constitutes a limiting stop which receives the roller 24 therein when the chair is in the upright position. As best seen in FIGS. 6 and 7, the end 40 of bent portion 38 of each track means 34 has a spring member 42 associated therewith which is secured to another bracket 41 which in turn is secured to the frame member 30 adjacent the bent portion 38, so as to permit the spring member 42 to set in an opening 43 formed in the back of each end 40. The spring members 42 are preferably leaf-springs which are so formed so as to conform to the roller 24 to apply pressure thereto and maintain the roller in position when the seat is in the upright sitting position. The springs are so designed that when a person pushes against the upper portion of back seat portion 12 the rollers 24 will become free of spring members 42 and the track means will move along the rollers until they reach the ends 36, constituting the reclining position for the seat 10.

The pillow 44 is preferably sewn to a rectangular piece of fabric 46 which in turn is secured to the counterweight member 48. When the pillow is draped over the chair the fabric will ride on the upper edge of the seat back portion thereof and the counterweight 48 will be contained within a rectangular cloth sheath 49 attached to the rear portion of the back portion 12. The counterweight 48 is movable within the sheath so that the pillow 44 may be positioned as desired by the user of the chair, but will be maintained in that desired position until moved again. Also, since the counterweight is contained within a sheath, when the recliner chair is in the reclining position the counterweight will be held against the rear of back portion 12 of the seat member 10.

Figure 9:
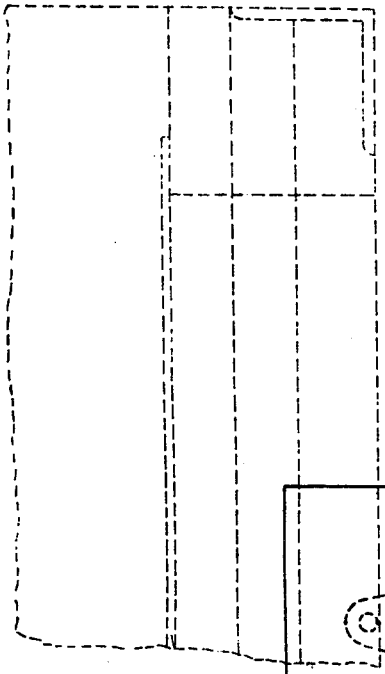
FIG. 9 is an expanded view of a portion of the ottoman illustrated in FIG. 3.
Figure 9:
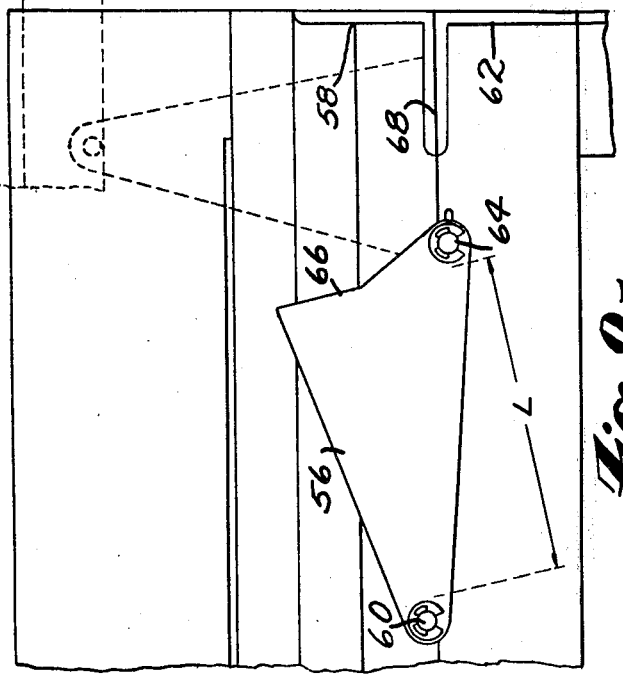
Figure 9A:
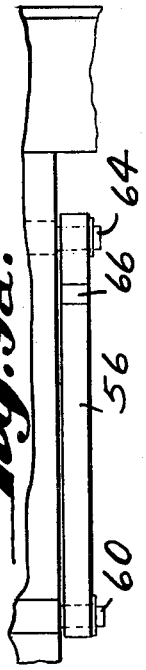
FIG. 9*a* is a top plan view of member 56 illustrated in FIG. 9.

The ottoman 50 comprises a cubical frame structure 52 forming legs of the ottoman and providing support for the cushion member 54 on the upper portion thereof when in the lower position. The cushion member 54 is secured to the frame member 52 on opposite sides thereof by a pair of hinge members 56 pivotally attached to the inner side of the frame. The frame 58 which supports the cushion is pivotally secured by pin 60 to the member 56 and the frame member 62 is pivotally secured by pin 64 to the opposite end of member 56. With the four members 56 secured to the ottoman as illustrated, when the cushion portion 54 is in the lowermost position the frame 58 will rest on the frame 62, and when the cushion is raised to the uppermost position the edge 66 of member 56 will rest on the upper portion 68 of frame member 62 and support the cushion member as shown in phantom in FIG. 9. The lowermost position of cushion 54 will correspond to the height of the front end of the bottom portion 14 of seat 10 and the uppermost position of cushion 54 corresponds to the front end of the bottom portion 14 of the seat when it is in the inclined position; thus providing support for the users legs at the appropriate level depending upon the position of the seat member and the cushion of the ottoman.

Figure 14:
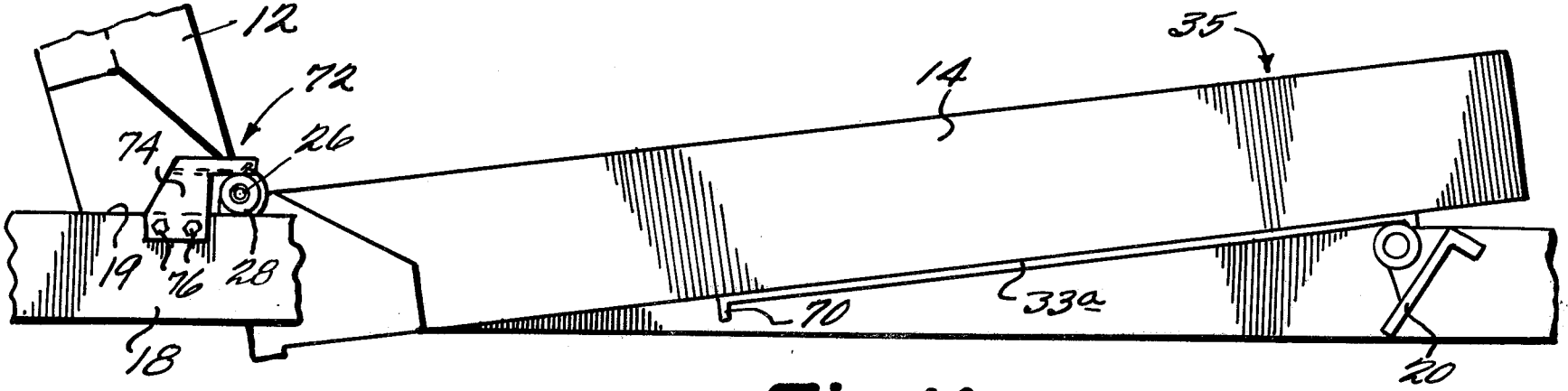
FIG. 14 is a partial side elevational view of another embodiment of a reclining chair according to the present invention showing the improved stop and retainer means.
Figure 15:
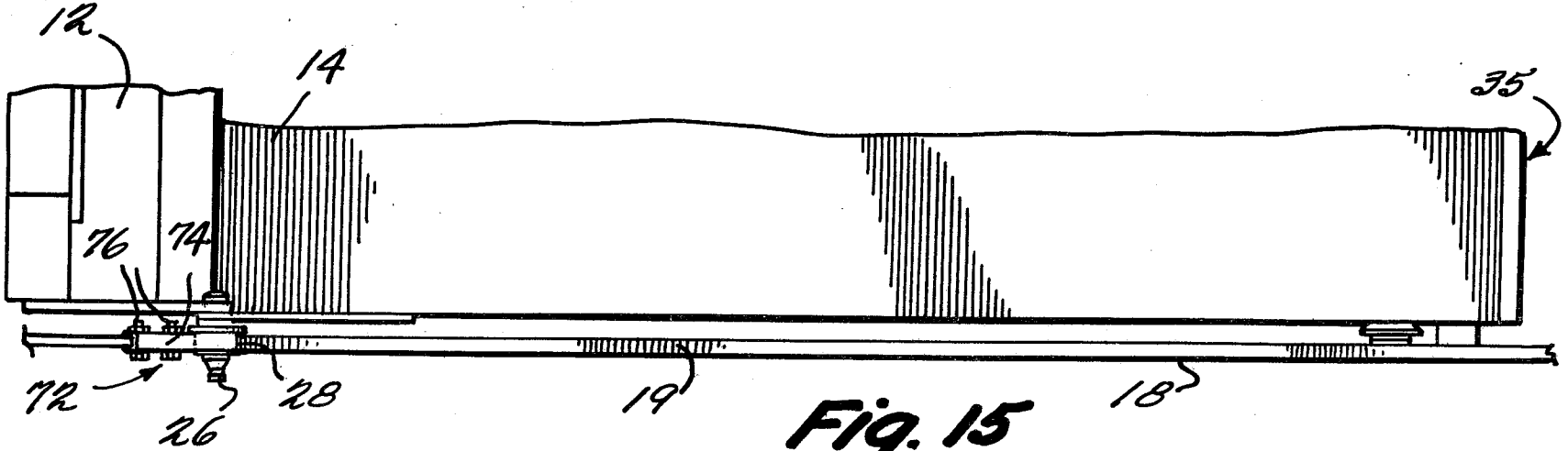
FIG. 15 is a partial top plan view of the embodiment shown in FIG. 14.
Figure 16:
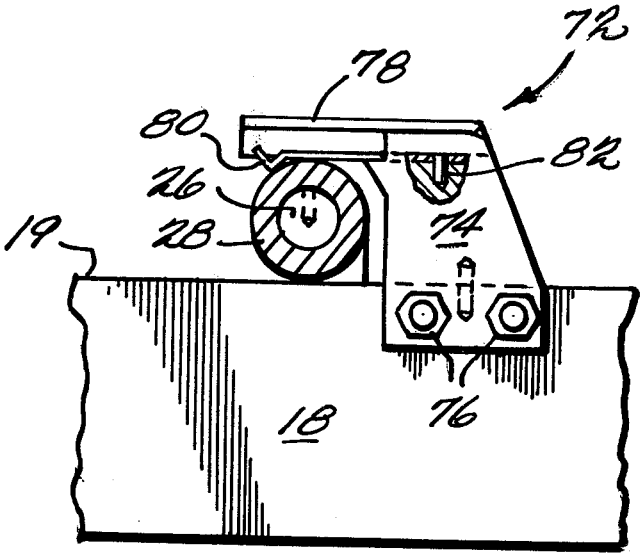
FIG. 16 is an expanded view in partial cross section with portions cut away of the track and retainer associated with the rollers attached to the seat at the pivotal connection of the back and bottom portions.

FIGS. 14–16 show a second embodiment of a reclining chair according to the present invention and particularly an improved stop arrangement for correctly positioning the seat in predetermined upright and inclined positions. This arrangement differs from that shown in FIG. 1 by making the track 34 on the rear of seat back 12 simply a straight element without bend portions 36 and 38. A modified track means 33*a* is provided on each side of the bottom portion's underside and also supportively cooperates with rollers 31. A bent portion 70 which extends substantially perpendicular to track 33*a* is provided at the rear thereof and constitutes a stop member which will contact roller 31 to limit further forward movement of bottom 14 when the seat is at its inclined position.

The other element in the improved stopping arrangement comprises a bracket assembly 72 which includes a support bracket 74 connected on each side member 18 by bolts 76. Bracket 74 also includes an extension portion 78 extending outwardly from the top thereof so that a U-shaped cavity is fomred between extension 78, bracket 74 and surface 19 of side members 18. A spring member 80 is retained in bracket 74 by pin 82 and extends outwardly into the U-shaped cavity adjacent extension 78 sized to receive roller 28 therein. As shown in FIG. 16, when the seat is in its upright position, roller 28 is within the U-shaped cavity and spring members 80, again preferably leaf-springs, are formed so as to conform to rollers 28 to apply sufficient pressure to rollers 28 to hold them within that cavity position. Spring members 80 are designed so that when a person pushes against the top of back portion 12, rollers 28 will become free of spring members 80 and dislodge and move along surface 19. Likewise, track 33*a* will move on rollers 31 until stop member 70 contacts rollers 31 thereby stopping further movement of seat 10 in its inclined position.

The use of this improved stop arrangement allows the chair back to be folded down without having to push the chair into a position between its reclined and upright positions. With the stopping arrangement shown in FIG. 1, movement of the seat was necessary to release the second track from the second roller prior to folding the seat back portion down to make the chair more compact.

Although the foregoing description illustrates the preferred embodiment of the present invention, it will be apparent to those skilled in the art that variations are possible. All such variations as would be obvious to those skilled in this art are intended to be included within the scope of this invention as defined by the following claims.

What I claim is:

1. An adjustable recliner chair comprising: a rigid frame structure; a seat member having a bottom and a back portion, movable between an upright position and an inclined position, said back portion being foldable over onto said bottom portion; means mounting the bottom portion to the back portion along adjacent edges thereof for relative pivotal movement therebetween; first roller and track means adapted to support the bottom portion on the frame structure at a forward portion thereof for substantially horizontal translational movement of the bottom portion relative to the frame structure; second roller and track means adapted to support the back portion on the frame structure for movement from an upright position to a reclining position; third roller and track means having a roller mounted on each side of the seat member substantially coincident with the mounting means and a substantially horizontal track mounted on the frame structure upon which the third rollers are supported for movement therealong; first limiting means secured to the bottom portion at the rear end of the first track means for stopping the movement of the bottom portion when the seat member is in the inclined position; second limiting means secured to the frame structure at a predetermined position for stopping movement of the third roller means when the seat member is in the upright position; said second limiting means including a retaining means for releasably retaining the third roller means against the second limiting means, said second limiting means comprises an L-shaped bracket mounted to said frame structure adjacent the position occupied by said third roller means when said seat is in its desired upright position so that a generally U-shaped cavity for receiving said second roller means is formed between said frame structure and said L-shaped bracket and wherein said retaining means is located within the generally U-shaped cavity and comprises a leaf spring having a bent end portion engageable with the roller means.

2. An adjustable recliner chair as in claim 1 wherein said first limiting means comprises a bent upper portion of each of the first tracks which extends substantially perpendicular to the tracks and contacts the first roller and prevents further movement of the first rollers beyond the inclined position of the seat member.

3. An adjustable recliner chair comprising: a rigid frame structure; a seat member having a bottom and a back portion, movable between an upright position and an inclined position; means mounting the bottom portion to the back portion along adjacent edges thereof for relative pivotal movement therebetween; first roller and track means adapted to support the bottom portion on the frame structure at a forward portion thereof for substantially horizontal translational movement of the bottom portion relative to the frame structure, said first roller means being attached to said rigid frame structure; second roller and track means adapted to support the back portion on the frame structure for movement from an upright position to a reclining position, said second roller means being attached to said rigid frame structure; third roller and track means having a roller mounted on each side of the seat member substantially coincident with the mounting means and a substantially horizontal track mounted on the frame structure upon which the third rollers are supported for movement therealong; said frame structure including a pair of side frames positioned on each side of said chair, each of said side frames including at least one cross member, said third track means including at least a portion of the upper surface of said cross member in said pair of side frames; said first track means being secured to the underside of said bottom portion of said chair and including a first limiting means for stopping movement of the seat member at its fully inclined position, said first limiting means being formed from a bent portion within and at the rear end of said first track means so as to come into contact with said first roller means thereby stopping the movement of the seat member when in the fully inclined position; said side frames including a second limiting means mounted at a predetermined position on the rear portion of said third track means, said second limiting means comprising a substantially U-shaped cavity sized to receive said third roller means therein thereby stopping movement of the seat member in the upright position; and retaining means secured within the substantially U-shaped cavity for releasably retaining the third roller means in contact with said second limiting means.

* * * * *